United States Patent [19]

Raymond

[11] 4,019,380

[45] Apr. 26, 1977

[54] UNDERWATER SAMPLER

[75] Inventor: Samuel O. Raymond, Falmouth, Mass.

[73] Assignee: Benthos, Inc., N. Falmouth, Mass.

[22] Filed: Mar. 8, 1976

[21] Appl. No.: 664,482

[52] U.S. Cl. ..... 73/170 A; 73/425.2

[51] Int. Cl.² ..... G01N 1/00

[58] Field of Search ..... 73/170 A, 425.4 R, 425.2

[56] References Cited

UNITED STATES PATENTS

| | | | |
|---|---|---|---|
| 3,509,772 | 5/1970 | Blair | 73/425.2 |
| 3,572,129 | 3/1971 | Walthier et al. | 73/425.2 |
| 3,885,440 | 2/1975 | Rossfelder | 73/425.2 |

*Primary Examiner*—Jerry W. Myracle
*Attorney, Agent, or Firm*—Schiller & Pandiscio

[57] ABSTRACT

A free-fall underwater sampler comprises a pair of jaw members and ballast supporting containers in which the jaw members and containers are operated simultaneously and independently of one another. A safety mechanism is also provided for preventing premature closing of the jaw members and release of the ballast. Other features and advantages are disclosed.

23 Claims, 9 Drawing Figures

50
52
52
48
46
126
124
122
116
120
14
190
190
28
186
45
44
194
44
45
47
47
49
49
194
36
36
111
115
111
115
24
108
108
24
180
182
188
192
190
184
190
112
112
160
158
162
26
150
174
152
156
154
34
34
110
110
113
32
32
118
176
170
157
117
42
130
116
118
122
114
114
116
14
40
172
100
126
12
40
30
30
86
98
86
84
54
84
20
20
82
94
18B
18A
96
96
60
62
76
72
66
66
72
64
70

UNDERWATER SAMPLER

This invention relates generally to apparatus for obtaining specimens of the earth under a body of water, and more particularly to underwater bottom samplers of the recoverable free-fall type.

Ocean or lake floor samplers or the recoverable free-fall type are usually dropped in the area where a specimen is to be taken and allowed to free-fall to the bottom of the body of water where the sampler obtains a specimen of the bottom and then floats to the water's surface were it can be retrieved with the specimen intact. These samplers have particular utility for obtaining specimens of an oceanic bottom to determine the presence of manganese nodules in preparation of oceanic mining.

Various types of samplers are known. One type of sampler is generally referred to as a "core sampler" and is, by way of example, described in U.S. Pat. No. 3,372,760. Another type of sampler, hereinafter referred to as the Walthier et al. sampler, comprises a pair of clam shell type jaws which dig into and grab a specimen of the sea bottom before floating to the top. The Walthier et al sampler is different from previously known coring type samplers in that the Walthier et al sampler is designed to sample manganese nodules lying on the surface of the ocean floor rather than take a core of sediment.

The Walthier et al. sampler, however, suffers from several disadvantages. One disadvantage arises from the fact that the weights which cause the Walthier sampler to sink to the bottom, are supported by each of the jaws. The weights fall off the jaws at an intermediate point during closing whereupon the sampler will return to the surface. However, serious problems can arise when the sampler lands on a hard bottom such as stiff clay (often the floor in regions of the deep ocean where manganese nodules are found consists of still clay). If the jaws of the grab cannot close due to the stiffness ofthe clay or because they have encountered an object such as a rock which prevents them from closing or for any other reason the ballast weights may be prevented from falling off the jaws. If the weights do not fall off the sampler, the sampler will maintain its negative buoyancy and thus will not float to the surface, resulting in a loss of the sampler itself. Further, since the triggering device of the Walthier et al sampler is dependent upon inertia, as the sampler sinks in the soft soil the actuating mechanism may not trigger. Anothe disadvantage of the Walthier et al sampler is that it can only use ballast weights of a specific size and shape, usually in the form of steel cylinders. These ballast weights are thus expensive and difficult to procure. Another disadvantage of the Walthier et al sampler is that if the leading or side edges of its jaws close on a nodule or stone they will be prevented from closing completely and some of the sample will be lost. Since this type of sampler is used to make quantitative sampling studies of proposed mining areas, it is important that the sampler close completely, thus recovering all of the nodules in its sampling area. Still another disadvantage of the Walthier et al sampler arises from the construction of the jaws themselves. For one thing, each jaw is equipped with a front edge cutting blade and sharpened side edges which engage the respective blade and edges of the other jaw when the jaws are closed. If a large nodule or similar solid object is lodged between the jaws when they are closing, the jaws may not close completely, in which case the ballasting weights might not roll off the jaws. Even if the weights do fall off, smaller nodules and objects, which would have been retrieved between the jaws had the jaws completely closed, more than likely will fall out as the sampler floats to the surface. Further, netting or canvas is attached to each of the jaws in such a way that a pocket is formed by the jaws and the netting or canvas when the jaws are in a closed position. However, this pocket is open at the top and thus a loss of some or all of the specimens taken from the bottom might occur through the open top. Finally, the sampler may bury itself in the bottom and its jaws may close under the desired surface sample.

It is generally an object of the present invention to provide a novel underwater sampler of the free fall type which overcomes the disadvantages of the Walthier et al sampler.

More specifically, an object of the present invention is to provide an underwater sampler in which the ballast releasing mechanism and the jaw members operate independently of one another.

Another object of the present invention is to provide an underwater sampler having a jaw biasing means which is not as susceptible to damage or interference from objects passing between the jaw members when the latter are in an open position.

Yet another object of the present invention is to provide an underwater sampler which provides means for preventing accidental actuating of the triggering mechanism and more particularly premature closing of the jaw members and release of the ballast.

Still another object of the present invention is to provide an underwater sampler in which the jaws tend to prevent objects from being lodged therebetween.

And still another object of the present invention is to provide an underwater sampler in which the specimen-receiving pocket formed by the closed jaws is completely closed.

And yet another object of the present invention is to provide an underwater sampler including means for providing resistance to soft muck to prevent the sampler from sinking too deeply.

And still another object of the present invention is to provide an underwater sampler which is adapted to use inexpensive, easily available steel scrap for ballast.

And yet another object of the present invention is to provide an underwater sampler in which the triggering mechanism for initiating the movement of the jaw members to a closed position and release of the ballast is not dependent upon inertia as in the Walthier et al. sampler.

These and other objects of the present invention are achieved by an underwater sampler of the free-fall type comprising a frame and ballast supporting means mounted to the frame for releasably supporting ballast. Two jaw members are mounted on the frame for movement between an open position wherein the jaw members are spaced from one another to a closed position wherein the jaws provide a closed specimen-retaining pocket. Resilient means are provided for moving the jaw members from the open position to the closed position. Actuation means are provided for initiating operation of the resilient jaw-closing means and for causing the ballast supporting means to release ballast when the sampler comes to rest on the bottom of a body of water. Finally, buoyant means are provided on the frame to return the sampler to the surface of the body of water after the ballast is released.

Other features and many of the attendant advantages of the invention are disclosed in or rendered obvious by the following detailed description which is to be considered together with the accompanying drawings in which.

In the drawing, like numerals refer to like parts.

Figure 1:
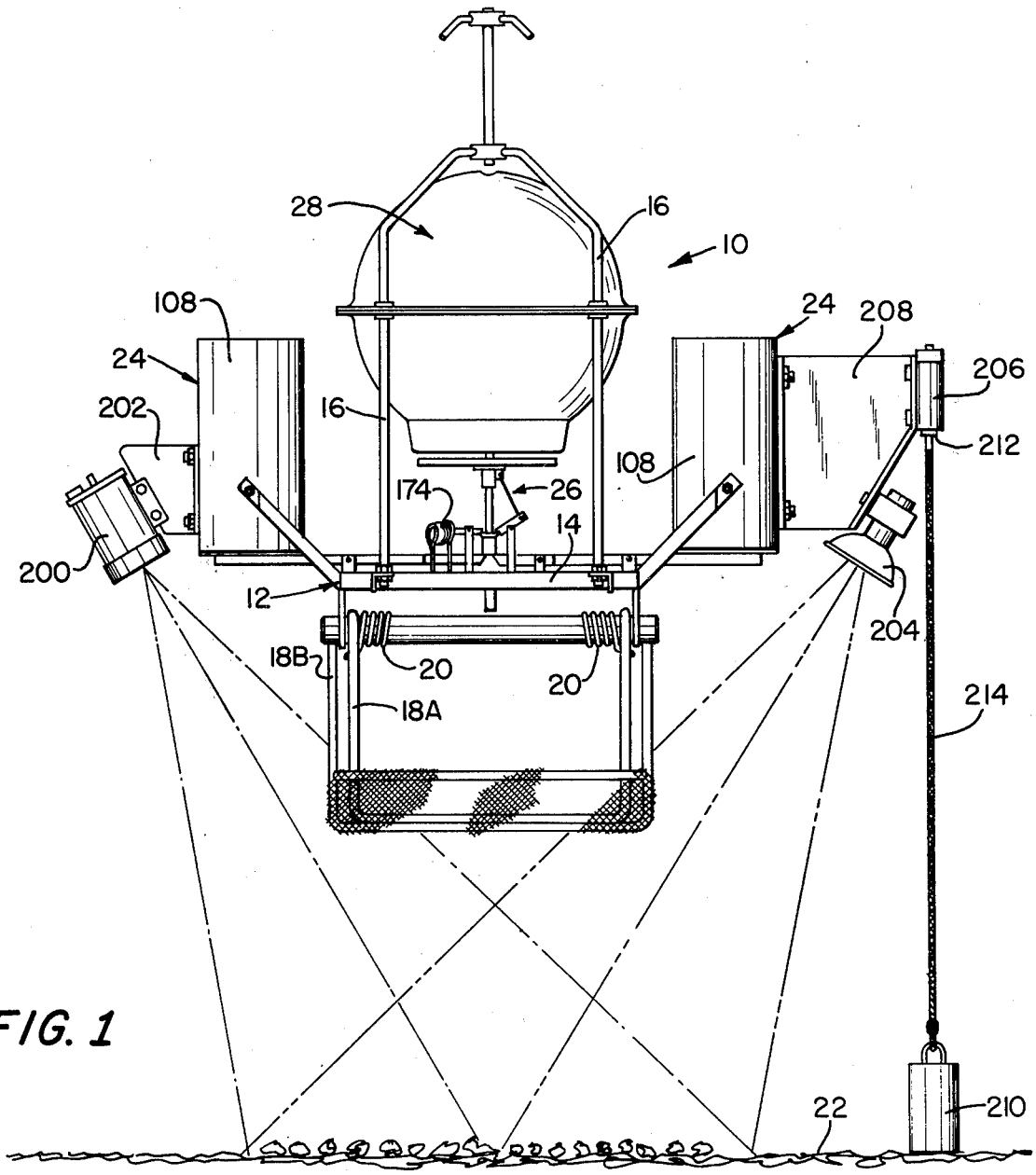
FIG. 1 is a front elevation of the preferred embodiment of the present invention.

Referring particularly to FIG. 1, the illustrated sampler 10 comprises a frame 12 including a base section 14 and an upright portion or cage 16. Pivotally connected to the base 14 are inner and outer jaw members 18A and 18B. The jaw members are movable by the action of a jaw moving means in the form of torsion coil springs 20 from an open position, wherein the jaw members are spaced from one another, to a closed position, wherein the jaw members help to define a sample retaining pocket for receiving a sample taken from the bottom 22 of a body of water. The sampler 10 also comprises ballast supporting means, generally referred to at 24 and mounted to the base section 14 of the frame 12, for releasably supporting ballast so that the sampler will sink to the botton 22. Means generally referred to at 26, are provided for initiating the jaw moving means 20 and for causing the ballast supporting means 24 to release ballast when the sampler is adjacent the bottom 22. Bouyant means 28 are mounted to the upright portion 16 of the support frame 12 for returning the sampler to the surface of the body of water after the ballast is released.

Referring to FIGS. 2 – 6, the sampler 10 will not be described in greater detail. The base section 14 of the frame 12 is preferably made of four L-shaped channel members secured together at their ends. Suitable cross-bracing and supporting channel members (not shown) for reinforcing the frame and for supporting the various parts are also provided. Base section 14 also includes two jaw-supporting plates 30, each connected at opposite sides of and extending in a downward direction from the base section. Additionally, the base section includes two pairs of support bars 32 (one of each pair being visible in FIG. 2) and two reinforcing bars 34 for supporting the ballast supporting means 24. Each pair of support bars 32 is secured to a corresponding one of the sides of the base section 14 to which the plates 30 are secured. Each support bar 32 is preferably disposed parallel to and spaced from the other support bar 34 at an upwardly-directed angle (of about 45° although the angle may vary) with respect to the plane defined by the base section 14 so as to give maximum support for the ballast supporting means 24 and yet remain clear of the area directly beneath means 24. The support and reinforcing bars 32 and 34 are attached at one end to the base section 14 and at the other end to the means 24 for holding ballast. The upright portion or cage 16 of the frame 12 includes four elongated upright tubes or rods 36 (three of which are shown in the drawings). The lower ends of rods 36 extend into mounting brackets 40 (the latter being secured to the base section 14 of the frame) and are secured against vertical movement by locking nuts 42).

The four upright rods 36 extend substantially parallel to one another and have upper and lower washers 44 and 47, which are used to secure the buoyant means 28 as described hereinafter. The upper and lower washers 44 and 47 of each rod 36 are maintained in position on the rod by the pin 45 which extends through an aperture in the rod 36 above the washer 44, and a cotter pin 49 which extends through an aperture formed in the rod 36 below the washer 47. The upper end of the rods are bent at an angle toward one another so that they extend above the buoyant means 28 and terminate substantially directly above the center of gravity of the sampler 10 at a connecting ring 46. An elongated rod 48 is connected at one end to the ring 46 and extends above the ring 46 and may be adapted to support a radio beacon, a flashing beacon or any other similar signaling device. The upper end of the rod 48 is provided with a second connecting ring 50, which in turn is provided with at least two and preferably three lifting hooks 52. The hooks are preferably formed of solid rods and are shaped so that they can be easily grasped by hand or by a gripping hook.

The various parts of the frame 12 are made of a corrosion resistant metal which is particularly adapted fur use in sea water. For example, stainless steel is an excellent long life material, although other materials may be used.

The jaw members 18A and 18B are suitably secured to a jaw pivot shaft 54. The shaft 54 is journaled in the plates 30. The shaft is preferably a hollow cylindrical element although it will be appreciated that it could be solid.

The inner and outer jaw members 18A and 18B each include U-shaped frames. The U-shaped frame of inner jaw member 18A includes a transverse section 64 joined at each end with a leg section 66. The leg sections 66 of the inner jaw member 18A are disposed substantially parallel to one another and their free ends are rotatably supported, in any suitable manner, on shaft 54 between the plates 30. For example, the free end of each leg section 66 of the inner jaw member can be formed in a substantially closed loop which encircles shaft 54 and is sized so that the inner jaw member can rotate freely about the shaft. The U-shaped frame of the outer jaw member 18B includes a transverse section 70 joined at each end with a leg section 72. The leg sections 72 of the outer jaw member are disposed substantially parallel to one another and their upper ends extend through holes in shaft 54 and are secured against movement relative to the shaft by any suitable means, such as cotter pins 73 and 74 (see FIG. 4). The leg sections 72 are connected to shaft 54 outside of plates 30 while the leg sections 66 of the inner jaw member 18A are connected to shaft 54 inside of plates 30. The leg sections 72 of the outer jaw member are also formed with a slight bend near the shaft 54 (see FIG. 4) so that when the jaw members are closed their frames will be substantially parallel to one another.

The inner and outer jaw members 18A and 18B also comprise cross-bars 60 and 62, respectively. The cross-bar 60 connects the leg sections 66, while the cross-bar 62 connects the leg sections 72. Each cross-bar is disposed parallel to the corresponding transverse section of the respective jaw member and is connected to the corresponding leg sections at points intermediate between the transverse section and the pivot shaft 54. The transverse section 70 and the leg sections 72 of the outer jaw member 18B are longer than the corresponding sections of the inner jaw member 18A, so that when the jaw members are pivoted to a closed position, the leg sections of the inner jaw member are positioned between the leg sections and transverse sections of the frame of the outer jaw member and spaced inward of the corresponding sections of the frame of the outer jaw member. The cross-bar 60 of the inner jaw member is located at substantially the same radial position as the cross-bar 62 of the outer jaw member relative to the axis of the shaft 54. Thus they can contact one another and keep the jaw members in an abutting relationship when the jaw members are closed. This creates a slight "overbite" relationship between the closed loop formed by the transverse section, leg sections and cross-bar of the outer jaw member and the closed loop formed by the corresponding sections of the inner jaw member. The advantage of this overbite relationship will be more fully explained hereinafter.

The U-shaped frames of the two jaw members are preferably made of the same material as the frame 12 and thus may be made of any corrosion resistant material such as stainless steel.

Figure 4:
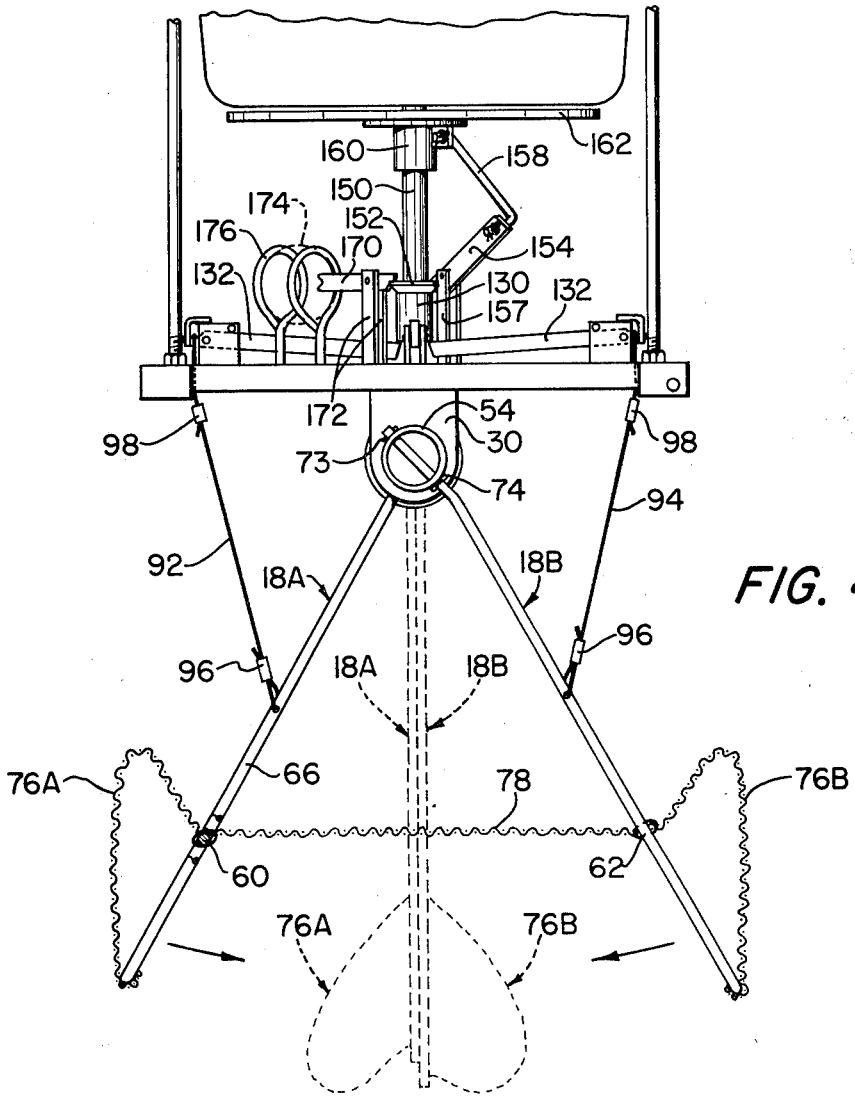
FIG. 4 is a fragmentary side elevation of the embodiment of FIG. 1 without the ballasting supporting means shown.

The jaw members are also provided with means for holding a specimen when the jaw members are in the closed position. The means comprises sample retaining sacks or bags 76A and 76B which are associated with the closed loops formed by the transverse sections, leg sections and cross-bar of jaw members 18A and 18B respectively. Each bag is attached in any suitable manner, e.g. by tieing the bag to the frame of the jaw member with metal wire or a nylon cord. Each bag is preferably formed from a flexible imperforate web or from netting or other mesh material and is dimensioned to buldge outwardly as shown in FIG. 4 when in the closed position. Advantageously, the bag 76 is formed from a flexible non-elastic material such as canvas or fine mesh fishnet. An intermediate netting section 78, which is preferably made of the same material as the two bags 76, is also attached to and extends between the cross-bars 60 and 62 of the two jaw members. This intermediate section 78 is under slight tension when the jaw members are in the open position (see FIG. 4) so that if the sample should land in soft muck, the intermediate section provides resistance and prevents the sampler from sinking too deeply. Preferably but not necessarily, the bags 76A and 76B and the intermediate section 78 constitute a single sheet of material.

The two coil springs 20 which constitute the jaw moving means surround and are positioned at opposite ends of the pivot shaft 54 between the two plates 30. Each spring 20 is formed at one end with a tang 82 which is disposed so that it extends behind and contacts the corresponding leg section 66 of inner jaw member 18A. The other end of each spring 20 is provided with a loop 84 which is secured to the pivot shaft 54 by any suitable means such as screws 86.

The jaw members are maintained in an open position against the action of the springs 20 by means of inner and outer jaw release cables 92 and 94, respectively. Each cable is secured to the leg sections of the frame of the respective jaw member by threading its opposite ends through holes provided in the leg sections just above the cross-bar. Each end of the cable is formed in a loop by securing the end to a cable clamp 96. The center portion of each cable is also provided with a second cable clamp 98 so as to provide a center loop 100. Each center loop 100 is connected to the means 26 for initiating operation of the jaw moving means 20 (means 26 are described in greater detail hereinafter). The length of cables 92 and 94 are such that when their center loops 100 are held by the means 26, the cables are under tension and the jaw members 18A and 18B are held open against the action of the springs 20 with the intermediate section 78 under tension. The cables may be made of any suitable single or multiple strand material capable of withstanding the tension forces placed thereon when the jaw members are held in the open position, e.g. a corrosion resistant metal such as stainless steel.

The means 24 for releasably supporting ballast preferably includes two substantially identical ballast tubs or containers 108 disposed at opposite sides of frame 12 so that when they are filled with like ballast material or when empty, their weight is evenly distributed with respect to the center of gravity of the sampler and thus no angular moment is imparted as a result of the presence of absence of the ballast. Each tub 108 is mounted between and secured to a pair of the support bars 32 of frame 12 by any suitable means such as bolts 110. Each tub is also conncted to one of the reinforcing bars 34 by providing a reinforcing band 112 around the tub and securing the band 112 to the reinforcing bar 34. In this manner each tub is prevented from moving with respect to the frame 12. The upper end of each tub also is provided with a removable top 111 which is held in place by suitable means such as screws 115. The bottom of each tub is open so that ballast 113 provided in the tub will spill out with little difficulty. A variety of scrap metals can be used as the ballast 113. For example, scrap washer slugs (center punchings) make excellent ballast.

Figures 2, 3:
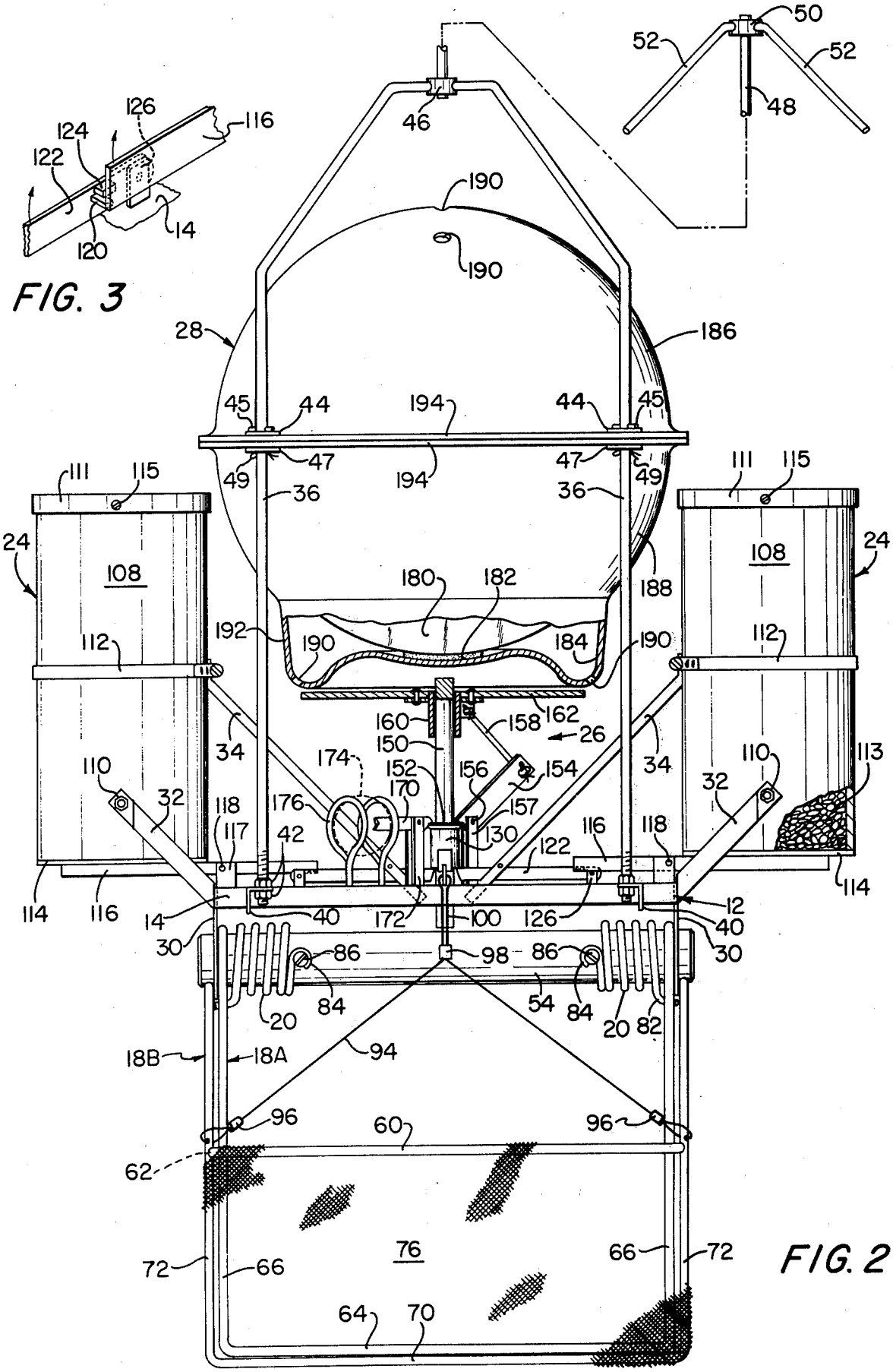
FIG. 2 is an enlarged front elevation, partly in section, of the preferred embodiment of the present invention without the camera or flash.
FIG. 3 is a perspective view of a portion of the ballast releasing mechanism.

The means 26 for initiating the jaw moving means 20 and for causing the ballast supporting means 24 to release ballast when the sampler comes to rest on the bottom 22 generally comprises two ballast retaining plates 114. Each plate 114 is connected to one end of a ballast retaining arm 116. Each arm 116 extends between a pair of pivot support plates 117 that are affixed to frame 12 and support a pivot pin 118 that extends through and pivotally supports arm 116. Each arm 116 is pivotable between a "cocked" position (shown in FIG. 2) wherein the ballast retaining plate 114 effectively covers the bottom of the tub 108 and thus prevents the ballast 113 from escaping, and a "triggered" position (shown in FIG. 4) wherein the ballast 113 is released through the bottom of the tub. As shown in FIG. 3, the end of each arm 116 opposite the plate 114 is provided with a block-shaped lug 120 which is held in place by a dog 124 on the end of a ballast retaining lever 122, when the means 26 for initiating operation is in the cocked position. Each ballast retaining lever 122 is pivotally supported on a pivot post 126 which in turn is secured to the base section 14 of the frame 12. The opposite end of the lever 122 is held in place by a release collar 130. It will be appreciated that the compound lever arrangement comprising the ballast retaining arm 116 and the ballast retaining lever 122 provides greater leverage strength in maintaining the retaining plate 114 under the tub 108, so that the plate holds the weight of ballast 113, than would be provided by a single lever arrangement.

Figure 5:
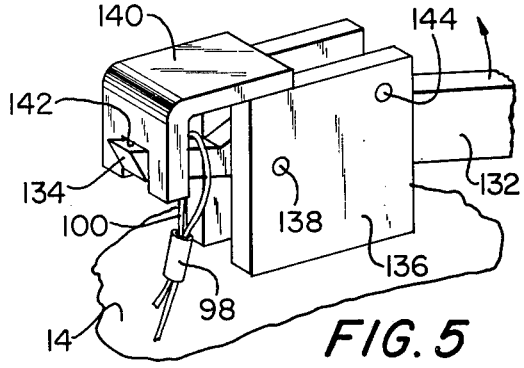
FIG. 5 shows a perspective view of a portion of the jaw releasing mechanism.

The means 26 for initiating operation of the jaw moving means 20 includes means for releasably holding the cables 92 and 94 so that the jaw members 18A and 18B are in open position. Referring specifically to FIGS. 4 and 5, a jaw release arm 132 is provided for each of the cables. Each arm 132 is formed at one end with a cable latching finger 134 and is pivotally supported at an intermediate point by a pivot pin 138 which is held by two pivot support plates 136 attached to base section 14 of frame 12. Arms 132 are pivotable between a "cocked" position (shown in FIG. 4) wherein the jaw release cables are held under tension and the jaw members open, and a "triggered" position (shown in FIG. 6) wherein the cables are released and the jaw members closed. Affixed to the support plates 136 is an L-shaped bracket 140 having a notch 142 formed along one edge thereof for engaging the cable latching finger 134 when the jaw release arm 132 is in the cocked position. The support plates 136 also are provided with aligned holes 144 for receiving a cotter pin (not shown) to hold the associated jaw release arm 132 in the cocked position when cocking the device. As shown in FIG. 5 the loop 100 of each jaw release cable is fitted over the finger 134 of a jaw release arm 132 and prevented from slipping off by the L-shaped bracket 140 when the jaw release arm 132 is in a cocked position as shown.

Figure 6:
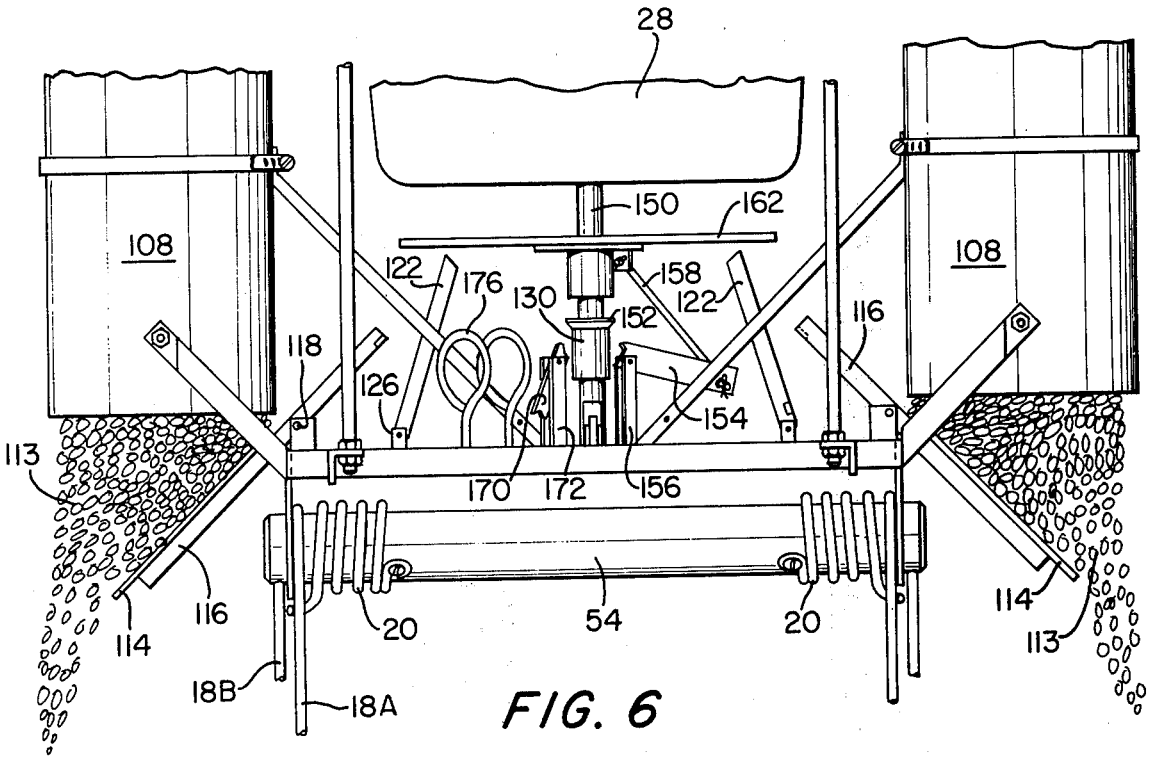
FIG. 6 is a fragmentary front elevation of the embodiment of FIG. 1 as the ballast is being released.

Referring to FIGS. 2, 4 and 6 the release collar 130 is slidably mounted on a guide rod 150 for movement into and out of engagement with the jaw release arms 132 and the ballast retaining levers 122 to hold the arms and levers in the cocked position. The collar 130 is provided at its upper end with a peripherial flange 152 which is engageable by one end of an actuating arm 154. The actuating arm 154 is pivotally mounted on a pivot pin 156 that is supported by a pair of posts 157 attached to frame 12, and is pivotable between a cocked position where it engages the flange 152 (as shown in FIG. 4) of the collar and a triggered position wherein it pivots away from the collar (shown in FIG. 6). The opposite end of arm 154 is connected to one end of a link 158. The opposite end of link 158 is connected to a sleeve 160 which in turn is slidably mounted on the guide rod 150 above the collar 130. Sleeve 160 is suitably connected to a flow plate 162 which slides with the sleeve on the guide rod 150. Plate 162 is a solid annular disk which resists the flow of water up along side rod 150 as the sampler sinks. Flow plate 162 will remain near the top of the rod 150 as the sampler is sinking, whereby actuating arm 154 will remain engaged with the flange 152 of the release collar 130 and maintain the ballast release levers 122 and jaw release arms 132 in the cocked position.

A safety mechanism is also provided for maintaining the sampler in a cocked condition when handling the sampler. The latter means comprises a ball release arm 170 which extends between and is pivotally supported on a pair of posts 172. One end of arm 170 is adapted to engage flange 152 of release collar 130 while the other end of the arm is notched to be held by a compressible ball (shown in phantom at 174 such as a tennis ball). The tennis ball is fitted between and gripped by two retainer eyes 176 which are anchored to frame 12. The ball will remain in place during launching of the sampler into the water and thus prevents the ball release arm 170 from pivoting out of engagement with collar 130, which in turn would cause the ballast in tubs 24 to be released and the jaw members 18A and 18B to close. Ball 174 is designed to compress sufficiently at a water depth of about 30 meters so that it is released from between the retainer eyes 176.

The buoyant means 28 for returning the sampler to the surface of the body of water after the ballast is released, preferably comprises a hollow glass sphere 180 (shown in FIG. 2) which is mounted on a resilient pad 182 within a protective plastic shell assembly 184. The sphere is preferably formed of relatively thick glass and is made in the manner disclosed in U.S. Pat. Nos. 3,587,122 or 3,563,089 so that it can withstand deep ocean water pressures. The sphere is evacuated or contains low pressure air so that when ballast is released at the bottom of a body of water, the sphere will provide sufficient positive buoyancy to raise the sampler to the top of the water. The pad 182 absorbs shocks and mechanical vibrations so as to help prevent damage to sphere 180. The protective shell assembly 184 comprises a top hemispherical shell or section 186 and a bottom partially hemispherical shell or section 188. Both shells 186 and 188 are provided with apertures 190 so that the water pressure remains substantially the same inside and outside of the shell assembly 184 regardless of the depth of the sampler. The bottom shell 188 is provided with an annular protuberance 192 which is disposed above the flow plate 162. The shells 186 and 188 are each provided with annular flanges 194 which have holes through which extend the rods 36. Flanges 194 are suitably clamped together by washers 44 and 47 which in turn are held in place by pins 45 and cotter pins 49. The protective shell assembly 184 may be made of any hard lightweight durable material such as polyethylene.

An important feature of the present invention is provided by the annular protuberance 192. The diameter of the annular protuberance is substantially equal to the diameter of the flow plate 162, whereby the protuberance helps to hold the plate 162 in its upper position on the guide rod 150 as the sampler sinks by preventing eddies of water from getting above the plate. This effect is assisted by the fact that as the sampler sinks a slightly lower pressure is maintained in the area above the top of the plate 162 (within the annular protuberance 192) as compared to the area below the bottom of the plate.

An optional feature of the present invention is provision of means for photographically recording the area of the bottom 22 where the sample is to be taken. Referring to FIG. 1 a camera 200 is shown mounted to one of the tubs 108 by means of a bracket 202. Similarly, an electronic flash light or flash bulb 204 and an actuating switch 206 are mounted to the other tub 108 by means of a bracket 208. The camera 200, electronic flash 204 and switch 206 are well known in the art and thus will not be described in great detail. Generally, the camera is actuated when the switch 206 is thrown from an "off" position to an "on" position. The actuation of the camera in turn actuates the flash which illuminates the area of the bottom and the camera records a photographic image. In order to actuate the switch 206 at the precise distance above the bottom at which the picture is to be taken, the switch is maintained in an off position by means of a weight 210 which is tied to the switch trigger 212 by means of a cable 214. So long as the cable 214 is maintained in tension by the weight 210 the switch will reamin off. However, when the weight 210 comes to rest on the bottom 22, the cable 214 relaxes and the switch 206 switches to an on position to actuate the camera 200 which activates the flash 204. It will be appreciated that camera 200 and electronic flash 204 are mounted so as to point toward the area of the bottom in which the sample is to be taken.

The operation and use of the sampler 10 will now be described in detail. Prior to dropping the sampler into the water where the bottom is to be sampled, camera 200 is loaded and positioned on the bracket 202. Next, the jaws 18A and 18B are forced to the open position against the bias of the torsion coil springs 20. The jaws 18A and 18B are secured in the open position by placing loops 100 of cables 92 and 94 around the fingers 134 of the corresponding jaw release arm 132. The collar 130 is raised sufficiently on the guide rod 150 so that the inner ends of each jaw release arm 132 may be pivoted down under the collar and so that its finger 134 pivots up into the notch 142 of plate 140 to secure the loop 100 between the finger and plate. The arms 132 may be held in this position by inserting cotter pins through the apertures 144 of the pivot support plates 136.

Next the ballast retaining plates 114 and arms 116 are pivoted into the cocked position so that plates 114 cover the bottom end of the tub 24. The ballast retaining levers 122 are then pivoted into place so that the dogs 124 engage the block-shaped lugs 120 of arms 116, whereby the latter will be prevented from pivoting about the pivot pin 118. The levers 122 and the arms 132 are then secured in place by sliding the release collar 130 down on the guide rod 150 into engagement with the ends of the levers 122 and arms 132. Next the flow plate 162 is moved up on the guide rod so that link 158 pivots the arm 154 until the end of the arm 154 engages the flange 152 of the collar 130. Next the arm 170 is pivoted so that its end engages the flange 152 of the collar 130 and a tennis ball 174 is positioned between the eyes 176 so as to hold arm 170 against collar 130. The device is now in the cocked condition so that the ballast 113 can be loaded into the tubs 108 and the top of each tub closed off by a cover plate 111. The cotter pins are removed from the apertures 144 of the pivot support plates 136. The sampler 10 is now ready to be dropped into the water at the desired location where a bottom specimen is to be taken. It is noted that when the sampler is being dropped into the water the tennis ball 174 will maintain the arm 170 against the flange 152 of release collar 130 so as to prevent the flow plate 162 from sliding down guide rod 150. With suitable ballast 113 in the tubs 108, the sampler has sufficient negative buoyancy to sink. As the sampler sinks, the water pressure compressing the tennis ball 174 increases. These compressive forces cause the ball 174 to shrink enough for it to slip out from between the eyes 176. This releases the arm 170 and allows the collar 130 to be retained in the cocked position only by the arm 154. So long as the sampler is sinking, the water flowing up through the frame against the underside of plate 162 produces a sufficient differential pressure to maintain it in the upper position on guide rod 150. When the sampler 10 nears the bottom 22 of the body of water, the weight 210 hits the bottom and switch 206 is triggered so that the flash 204 illuminates the bottom 22 and the camera 200 takes a picture. When the sampler 10 reaches the bottom 22, the flow of water past the plate 162 stops. Without the differential water pressure against the bottom of the plate, there is insufficient force exerted on the actuating arm 154 to hold collar 130 down. As a consequence, the combined upward forces exerted on the collar 130 by the levers 122 and arms 132, push collar 130 up the guide rod 150. As the collar 130 moves up guide rod 150, arm 154 rotates causing line 158 to pull the sleeve 160 and flow plate 162 down the guide rod. This causes link 158 and arm 154 to release collar 130 so that it is free to slide upwardly on the guide rod 150. The release of collar 130 causes the dog 124 of each ballast retaining lever 122 to pivot slightly (under the influence of the ballast in tubs 108) out of locking engagement with the lug 120 of the corresponding ballast retaining arm 116, whereby each ballast retaining arm 116 is free to pivot with its plate 114 so that the ballast 113 spills out of the bottom of the tubs 108 as shown in FIG. 6.

The release of collar 130 also frees the jaw release arms 132 so that the latter can pivot from the cocked position to the release position. The jaw release cables 92 and 94 which are under tension pull the fingers 134 of arms 132 down far enough so that loops 100 can slide off the fingers, whereby jaw members 18A and 18B will close under the action of the springs 20. As the jaw members 18A and 18B close, particulate objects on the bottom 22 are collected in the bags 76 where they are retained by the closed pocket formed by the bags. It is noted that since the transverse section and leg sections of the inner jaw member 18A are slightly smaller than the corresponding sections of the outer jaw member 18B, any objects caught between opposing sections 64 and 70 of the jaw members will tend to rotate as the jaw members try to close fully. Thus the overbite relationship of the two jaw members tends to prevent an object from lodging therebetween. It will be appreciated also that if the sampler 10 lands in soft muck, the intermediate netting section 78 will tend to prevent the sampler from sinking too deeply before the flow plate 162 moves down far enough to effect release of the ballast 113 and the jaw members 18. The springs 20 are made strong enough to assure that the jaw members can close even while partially submerged in mud. Once the ballast 113 is released the sampler will have a positive buoyancy and thus will float to the top of the water. It will be appreciated that where the bags 76 are made of a mesh material the objects within the pocket formed by bags 76 will be washed by the water as the sampler moves upwardly.

If desired, a flag, a radiobeacon, flashing light beacon or other signaling device may be provided on the rod 48 to provide a signal to the launcher of the sampler as to the location of the latter when it reaches the surface.

Figure 7:
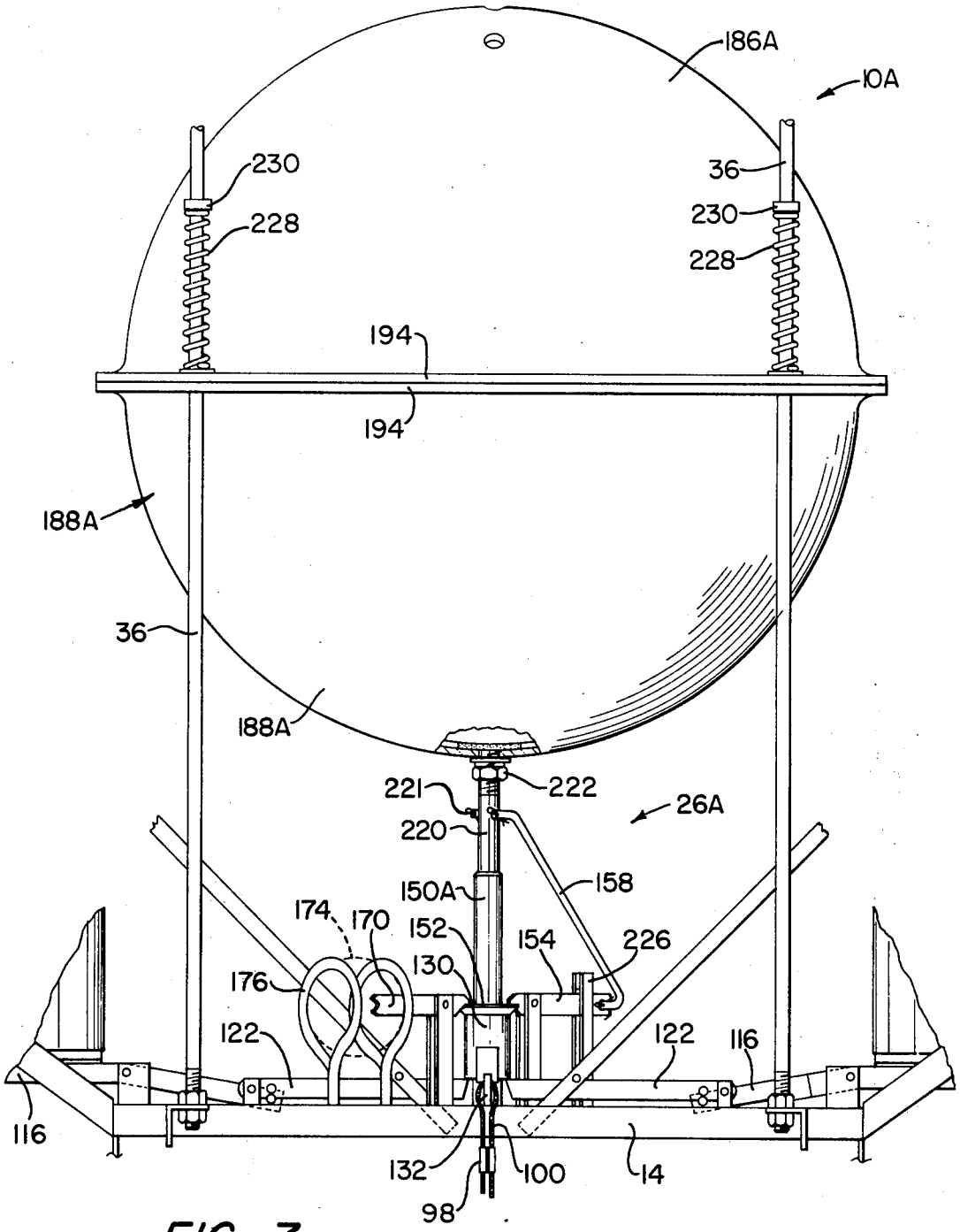
FIG. 7 is a fragmentary front elevation, partly in section, of a portion of an alternative embodiment of the present invention.

Referring to FIG. 7, an alternative embodiment of the present invention is illustrated. The alternative embodiment is identical with the preferred emobodiment of FIGS. 1 – 6, except that the means for initiating closing of the jaws and for causing the ballast to be released has been modified. Specifically, the means 26A includes hollow tube 150A and a telescoping rod 220 which is slidably mounted within tube 150A. The top end of rod 220 is secured by suitable means 222 to the bottom protective shell assembly section 188A. One end of the release arm link 158 is pivotally connected at 221 to rod 220, while its other end is pivotally secured to one end of actuating arm 154. The other end of arm 154 engages the release collar 130 in the manner previously described. A guide in the form of two parallel posts 226 can be provided for guiding arm 154 as it pivots into and out of engagement with release collar 130. The protective shell assembly has been modified to comprise two substantially hemispherical shells or sections 186A and 188A wherein the protuberance 192 is eliminated since the flow plate 162 is not used. Hemispherical shell 188A is slidably mounted on the upright rods 36. A spring 228 is provided on each upright rod to bias the protective shell assembly and the buoyant means in a downward direction. One end of each spring 228 engages a flange 230 formed on each upright rod 36 above the flanges 194 of the protective shell assembly. The opposite end of the spring 228 engages the flange of protective shell section 186A in order to bias the protective shell assembly and the buoyant sphere therein in a downward direction.

Sampler 10A operates in a similar manner as that of the sampler 10 previously described. Generally, the jaw are open against the bias of he torsion coil springs 20. While the jaws are held open, the loop 100 of cables 94 and 96 are looped around the fingers 134 of jaw release arms 132 and locked in place. Further, the ballast retaining plates 114 and arms 116 are pivoted into the cocked position wherein the plates cover the bottom of the tubs 108. The ballast retaining lever 122 is then pivoted into place so that the dog 124 engages the lug 120 of the arm 116 in order that the latter remains in the cocked position and is prevented from pivoting about the pivot pin 118. The levers 122 and the arms 132 are then held in place by sliding the release collar 130 on the guide rod 150A down into engagement with the ends of the levers 122 and arms 132. The ball release arm 170 is then pivoted so that its end engages the annular flange 152 of the release collar 130 and the other end engages a tennis ball 174 between the eyes 176. The device is now in the cocked condition and ballast can then be loaded into the tubs 108. The sampler can then be dropped in the water and as the sampler 10A sinks, sufficient pressure is placed on the protective shell assembly and buoyant means to maintain them in an upper position against the bias of the springs 228. As the sampler 10A sinks the tennis ball 174 compresses and escapes from between the eyes 176, releasing the ball release arm 170 from the flange 152 of the collar 130. When the sampler 10A reaches the bottom 22, the action of the springs 228 which is no longer resisted by the water flow encountered when the sampler is falling causes the protective shell assembly 184 to slide down the upward rods 36. This causes the rod 220 to telescope into the guide rod 150A. This in turn causes link 158 to pivot the arm 154 so that the release collar 130 is released. The collar is then free to slide upwardly on the guide rod 150A. The release of the collar 130 causes the ballast to be released, the jaws to close and the sampler to rise again to the surface, in the manner previously described.

Figure 9:
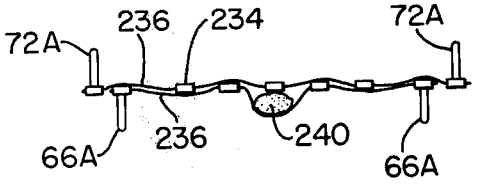
FIG. 9 illustrates, in a bottom schematic view, an advantage of the embodiment of FIG. 8.
Figure 8:
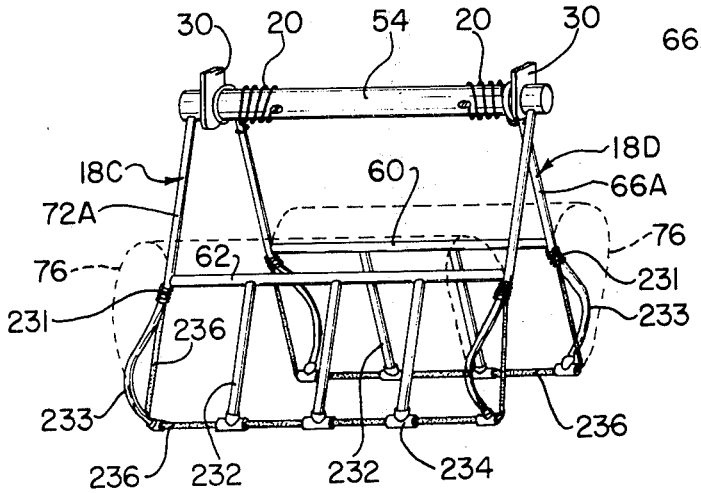
FIG. 8 is a perspective view of a portion of a second alternative embodiment of the present invention.

Referring to FIGS. 8 and 9, an alternative arrangement of the jaw members is described. The jaw members 18C and 18D are substantially identical as the jaw members 18A and 18B, of the embodiment of FIGS. 1 – 6, except that the leg sections 66A of member 18D and leg sections 72A of member 18C are bent at the point 231 where they are connected to the cross-bars 60 and 62, respectively, in a direction away from the opposite jaw member and again at point 233 between the first bend and the extreme end of each leg section. The bends at points 231 and 233 are made so that the portions of the leg sections, extending out from the point 231 where they intersect the respective cross-bar, are spaced from one another when the jaw member are in a closed position. A plurality of fingers or tines 232 are also provided on each jaw member. The fingers 232 of each jaw member are each attached at one end to a cross-bar and extend parallel to one another and generally to the inner radial portions of the leg sections extending between the shaft 54 and point 231 of the corresponding jaw member. The fingers 232 are located along the cross-bar of each jaw member so that when the jaw members 18C and 18D are in a closed position the fingers of one jaw member will be alternately positioned between the fingers of the other jaw member. The ends of fingers 232 as well as the leg sections of each jaw member are provided with tubular sleeves 234, the sleeves of each jaw member being substantially coaxially aligned with one another.

Each of the transverse sections 64 and 70 of the embodiment of FIGS. 1 – 6 is replaced with a flexible, elastic tube 236. The latter is made of rubber, plastic or the like and is designed to be threaded through the sleeves 234 of a jaw member, stretched, and have its ends tied at opposite ends of the cross-bar at points 231. A sack 76 is attached to the cross-bar and the entire length of the elastic tube so as to form the specimen retaining pocket in a manner as previously described. As shown in FIG. 9, the elastic tubes 236 help reduce the chances of an object from being caught between and preventing the jaw members from completely closing as the latter move to a closed position. Any relatively small object, such as nodule 240 caught between the leading or side edges of the tube 236 of one jaw member on the one hand and the tube 236 of the other jaw member on the other hand will tend to stretch the tubing and allow the fingers 232, and more particularly the jaw members to close.

The apparatus thus described provides an underwater sampler of the free-fall type which has several advantages over the prior art samplers. Specifically, the ballast supporting means 24 is adapted to release ballast independently of whether the jaws close or not. Also the jaws can close independently of ballast discharged from tubs 108. The intermediate section 176 further prevents the sampler from sinking too deeply in soft muck or the jaws closing under a surface sample. The fact that the triggering mechanism of both embodiments is not dependent on inertia but is controlled by the velocity of the water flowing past plate 162 or float assembly 184A insures that the ballast 113 will be released and the jaw moving means 20 activated regardless of whether the sampler comes to a sudden or gradual stop. Further, the torsion coil springs 20 are not likely to be damaged from objects passing up between the jaw members when the latter are in the open position, especially with the protection of the intermediate netting section 78 extending between the jaw members. Additionally, the arming mechanism in the form of the ball release arm 170 and tennis ball 174 is a safety feature that prevents accidental premature closing of the jaw members 18A and 18B and release ofthe ballast 113. Still other advantages will be obvious to persons skilled in the art.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. A sampler for obtaining a specimen of the bottom of a body of water comprising;

a frame;

ballast supporting means mounted to said frame for releasably supporting ballast whereby said sampler is caused to sink to the bottom of a body of water;

first and second jaw members mounted on said frame for relative movement between an open position wherein said jaw members are spaced from one another and a closed position wherein said jaw members oppose each other and provide a specimen retaining pocket;

jaw moving means for moving said jaw members relative to one another from said open position to said closed position;

control means for independently initiating operation of said jaw moving means and causing said ballast supporting means to release ballast when said sampler reaches the bottom of a body of water; and buoyant means on said frame to return the sampler to the surface of the body of water after the ballast is released.

2. A sampler in accordance with claim 1, wherein said ballast supporting means includes at least one container having an open bottom, and a plate movable between a first position wherein said plate covers said open bottom and a second position wherein said plate is displaced from said open bottom, and further wherein said control means allows said plate to move from said first position to said second position when said sampler comes to rest on the bottom of a body of water.

3. A sampler in accordance with claim 2, wherein said ballast supporting means includes two of said containers, said containers being balanced with respect to the center of gravity of said sampler so that said ballast will not impart angular momentum to said sampler when said sampler is allowed to free-fall in said water.

4. A sampler in accordance with claim 2, wherein said ballast supporting means further includes an arm pivotally secured to said frame and attached at one end to said plate, and said control includes a pivotally mounted lever movable between a cocked position wherein it engages the other end of said arm and holds said plate in said first position and a triggered position wherein it disengages said arm so that said plate is free to move to said second position, and means for releasing said lever from said cocked position.

5. A sampler in accordance with claim 4 wherein said means for releasing said lever includes a guide rod secured to said frame and a release collar slidably mounted on said rod between a first position wherein said lever is in said cocked position and a second position wherein said lever is free to move to said triggered position.

6. A sampler in accordance with claim 1 further including a rotatable shaft for pivotally mounting said jaw members to said frame, said first jaw member being connected to said shaft so as to be rotatable with said shaft, and said second jaw member being rotatably supported by said shaft.

7. A sampler in accordance with claim 6 wherein said jaw moving means includes resilient means for biasing said jaw members into said closed position.

8. A sampler in accordance with claim 7 wherein said resilient means includes at least one torsion coil spring having one end attached to said shaft and a tang at the other end for biasing said second jaw member relative to said shaft.

9. A sampler in accordance with claim 7 further including releasable means for releasably maintaining said jaw members in said open position against the bias of said resilient means.

10. A sampler in accordance with claim 9 wherein said releasable means includes a pair of jaw release cables, each attached to a corresponding one of said jaw members, and means for maintaining said jaw release cables under tension so as to hold said jaw members in said open position.

11. A sampler in accordance with claim 10 wherein said means for maintaining said jaw release cables under tension includes a pair of arms, each pivotally supported by said frame and having first and second opposite ends, said first end of each arm being adapted to hold a corresponding one said cables under tension when said arm is in a first position and to release said cables when said arm is in a second position, and means, for releasably holding said arms in said first position.

12. A sampler in accordance with claim 11 wherein said means for releasably holding said arms includes a guide rod secured to said frame and a release collar slidably mounted on said rod between a hold position wherein said collar engages the second ends of said arms and holds said arms in said first position and a release position wherein said arms are free to move to said second position.

13. A sampler in accordance with claim 6 wherein each of said jaw members includes a U-shaped frame, the U-shaped frame of one of said jaw members being smaller than the U-shaped frame of the other jaw member so that an object caught between said U-shaped frames tends to rotate out from between said U-shaped frames as said jaw members move from said open position to said closed position.

14. A sampler in accordance with claim 6 wherein each of said jaw members includes a bag, said bags cooperating with one another to provide a closed specimen retaining pocket when said jaw members are in said closed position.

15. A sampler in accordance with claim 1 wherein said control means includes a guide rod connected to said frame and a release collar slidably mounted on said guide rod between a (1) hold position wherein said jaw members are held in said open position and said ballast is retained by said ballast supporting means and (2) a release position wherein said ballast supporting means releases the ballast and said jaw moving means moves said jaws to said closed position, and means sensitive to water flow past said sampler for releasably holding said release collar in said hold position.

16. A sampler in accordance with claim 15 wherein said last mentioned means comprises a flow plate mounted on said guide rod and connected to said release collar so that said plate is maintained in a first position when said sampler free falls in said body of water and a second position when said sampler is at rest, and means linking said plate to said release collar so that when said plate moves from said first position to said second position said release collar is free to move from said holding position to said release position.

17. A sampler in accordance with claim 15 wherein said last mentioned means comprises a telescoping rod slidably mounted in said guide rod and connected at one end to said buoyant means, and actuating means linking said telescoping rod and buoyant means to said release collar, said buoyant means being moveable relative to said frame between a first position when said sampler free falls in said body of water and a second position when said sampler comes to rest on the bottom of said body of water, and said actuating means moveable by said buoyant means between a first position whereby said release collar is maintained in said hold position and a second position whereby said release collar is in said release position.

18. A sampler in accordance with claim 17 further including means for biasing said buoyant means toward its said second postion.

19. A sampler in accordance with claim 15 further including means for maintaining said release collar in said hold position so as to prevent premature movement of said release collar to said release position.

20. A sampler in accordance with claim 19, wherein said last-mentioned means includes ball-holding means for temporarily holding a compressible ball on said frame and a lever mounted on said frame for movement between a first position wherein one end of said lever is engaged and held by a ball held by said ball holding means and the other end of said lever engages and maintains said release collar in said hold position, and a second position wherein said other end of said lever is disengaged from said release collar, said lever automatically moving from said first position to said second position when said compressible ball is released from said ball holding means.

21. A sampler in accordance with claim 6, wherein each of said jaw members includes a plurality of fingers extending parallel to one another and attached at one end to said jaw member, and a flexible, elastic tube stretched between and connected to the other ends of said fingers, wherein said fingers of one jaw member are parallel to and alternately positioned between the fingers of the other jaw member and said tubes of said jaw members are oppositely disposed when said jaw members are moved to said closed position.

22. A free-fall type sampler for obtaining a specimen of the bottom of a body of water comprising;

a frame;

ballast supporting means supported by said frame for releasably holding ballast whereby said sampler is caused to sink to the bottom of a body of water;

first and second jaw members supported by said frame for relative movement between an open position wherein said jaw members are spaced from one another and a closed position wherein said jaw members oppose each other and provide a specimen retaining pocket;

jaw moving means for moving said jaw members relative to one another from said open position to said closed position;

control means for independently and simultaneously initiating operation of said jaw moving means and causing said ballast supporting means to release ballast when said sampler reaches the bottom of a body of water; and bouyant means supported by said frame for returning the sampler to the surface of the body of water after the ballast is released.

23. A sampler according to claim 22 wherein said control means comprises an actuating member which is restrained against operation by a differential water pressure only so long as the sampler is dropping in the body of water and is released when the sampler stops its descent.

* * * * *